US006153985A

United States Patent [19]

Grossman

[11] Patent Number: 6,153,985

[45] Date of Patent: Nov. 28, 2000

[54] LED DRIVING CIRCUITRY WITH LIGHT INTENSITY FEEDBACK TO CONTROL OUTPUT LIGHT INTENSITY OF AN LED

[75] Inventor: Hyman Grossman, Lambertville, N.J.

[73] Assignee: Dialight Corporation, Manasquan, N.J.

[21] Appl. No.: 09/349,769

[22] Filed: Jul. 9, 1999

[51] Int. Cl.[7] ..... G05F 1/00

[52] U.S. Cl. ..... 315/291; 315/149; 315/150; 315/156

[58] Field of Search ..... 315/291, 159, 315/149, 150, 156; 363/89; 359/189; 250/199, 214, 205, 201.5, 216, 271, 458.1

[56] References Cited

U.S. PATENT DOCUMENTS 5,608,225 3/1997 Kamimura et al. ..... 250/458.1

*Primary Examiner*—Don Wong
*Assistant Examiner*—Irinh Vo Dinh
*Attorney, Agent, or Firm*—Oblon, Spivak, McClelland, Maier & Neustadt, P.C.

[57] ABSTRACT

An LED indicator system with at least one LED, and driving circuitry for driving the at least one LED. A power supply supplies a drive current to the at least one LED. A photodetector detects a luminous output of the at least one LED and correspondingly outputs a detection signal. A conditioning circuit removes signal components indicative of stray light from at least one source other than the at least one LED, for example from sunlight reflected off of an LED array including the at least one LED, from the detection signal. As a result, the conditioning circuit generates a synthesized intensity feedback signal to provide to the power supply. The LED indicator system and driving circuitry for the at least one LED may further include a controller which compares the current supplied by the power supply to the at least one LED with the synthesized intensity feedback signal. A transmitter may transmit a signal indicating a result of the comparison executed by the controller.

19 Claims, 4 Drawing Sheets

LED DRIVING CIRCUITRY WITH LIGHT INTENSITY FEEDBACK TO CONTROL OUTPUT LIGHT INTENSITY OF AN LED

BACKGROUND OF THE INVENTION

1. Field of the Invention

The present invention is directed to an LED indicator and a driving circuit to drive an LED. More particularly, the present invention is directed to an LED indicator and a driving circuit that can drive an LED with a compensation for a loss in the luminous output of the LED. This invention can find particular application when the LED is utilized in a device such as a traffic signal or another indicating signal.

2. Discussion of the Background

The use of LEDs in indicating devices, such as traffic signals, is known. One drawback with using LEDs in an indicator such as a traffic signal is that luminous output of an LED degrades with both time and increasing temperature. For red LEDs degradation with respect to temperature will typically result in a loss of approximately one percent of intensity of the LED with every one degree Celsius increase in temperature. Conversely, as temperature decreases, intensity of light output from an LED increases. Moreover, LEDs gradually degrade over time, and thus become dimmer as they get older.

Known systems sense temperature at the LED or sense light output at the LED. and utilize the sensed temperature or sensed light output as a feedback to a power supply. Such a system is disclosed in U.S. Pat. No. 5,783,909 to Hochstein. This patent discloses (1) sensing temperature at an LED or sensing intensity output from an LED, (2) feeding back a signal proportional to the sensed temperature or intensity to a power supply, and (3) then increasing or decreasing the average current output by the power supply based on an increase or decrease in temperature in the light output of the LED.

In such a known system, sensing a luminous output of an LED may provide a benefit over sensing a temperature at the LED. Specifically, sensing luminous output of an LED allows compensation for both temperature-induced and age-induced degradation of the luminous output by the LED.

However, providing a photosensor to accurately detect the luminous output of an LED is somewhat problematic.

More particularly, to accurately detect the luminous output of an LED all other external stray light sources, e.g. sunlight, must be disregarded. That is, to provide an accurate feedback signal of a luminous output of an LED a photodetector must only detect the luminous output of the LED and cannot be affected by other forms of stray light, such as sunlight.

A second requirement of a photosensor is that it must gather light from a large enough sample of LEDs to be representative of all the LEDs in the lamp.

OBJECTS OF THE INVENTION

Accordingly, one object of the present invention is to provide an LED device with novel drive circuitry for an LED which can provide an accurate feedback signal of a luminous output of the LED.

A further more specific object of the present invention is to provide a novel drive circuit for an LED in which a feedback signal indicative of the luminous output of an LED is appropriately conditioned to eliminate the effect from external light sources, such as sunlight, so that the feedback signal provides an accurate representation of the luminous output of the LED.

A further more specific object of the present invention is to ensure that the appropriately compensated feedback signal is of a proper form for a power supply supplying power to an LED.

A further more specific object of the present invention is to utilize information from the novel drive circuitry to provide an indication of any improper operating conditions of the LED device or drive circuitry.

SUMMARY OF THE INVENTION

The present invention achieves these and other objects by providing a novel LED indicator with at least one LED, and novel driving circuitry for driving the at least one LED. In the present invention a power supply supplies current to the at least one LED. A photodetector detects a luminous output of the at least one LED and correspondingly outputs a detection signal. A conditioning circuit removes signals generated from stray light, for example from sunlight reflected off of an LED array including the at least one LED, from the detection signal. As a result, the conditioning circuit generates an intensity feedback signal to provide to the power supply.

As a further feature in the present invention, the novel LED indicator and novel driving circuitry for the at least one LED may further include a controller which compares the current supplied by the power supply to the at least one LED with the synthesized intensity feedback signal. As a further feature in the present invention, a transmitter may transmit a signal indicating a result of the comparison executed by the controller.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
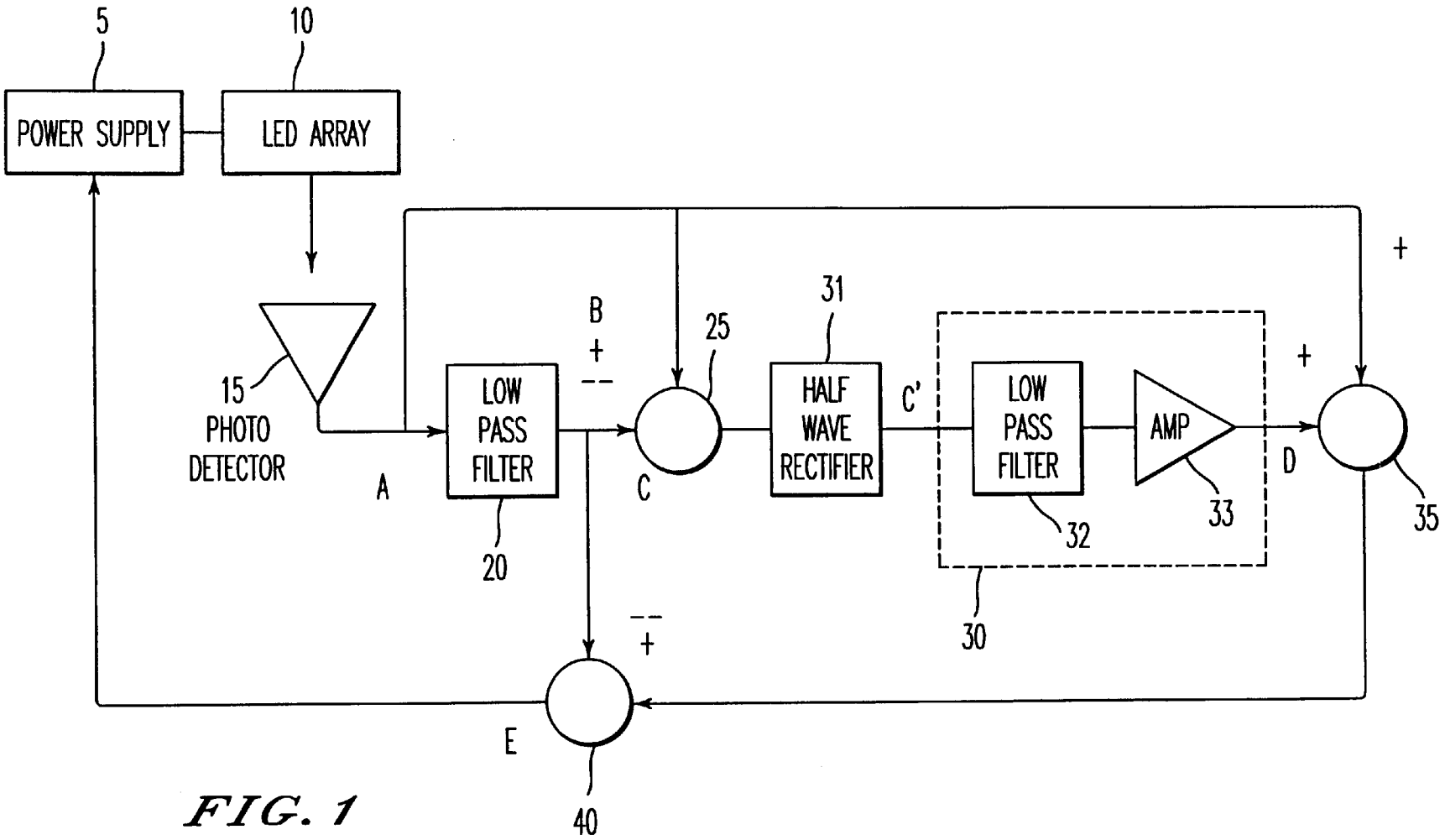
FIG. 1 shows one implementation of an LED indicator device and driving circuit according to the present invention.

Referring now to the figures, wherein like reference numerals designate identical or corresponding parts throughout the several views, a pictorial example of an LED indicator device and LED driving circuit of the present invention is disclosed.

The present invention is directed to an LED indicator device and a driving circuit for an LED which can provide a feedback of an luminous output of the LED to control the drive current provided to the LED.

As shown in FIG. 1, in the present invention a power supply 5 provides power to illuminate an LED array 10. One typical form of the power supply 5 is a switching power supply which can employ power factor correction, current or voltage regulation, etc. The power supply 5 may specifically take the form of a flyback converter with power factor correction incorporated in a commercially available IC, such as the Unitrode UC2852N. The LED array 10 may be a series or series-parallel arrangement of LEDs, and could also merely be a single LED. The present invention may find particular application as an LED traffic signal. In the context of LED traffic signals, the LED array 10 will typically be formed of parallel strings of series connected LEDs. A parallel connection of such LEDs provides redundancy in the event that one string of LEDs becomes inoperative. In a preferred embodiment the power supply 5 is a flyback current regulator based on the Unitrode UC2852N chip which drives the LED array 10 with a DC current and a fairly large sinusoidal current ripple of twice the line frequency. This ripple is characteristic of flyback-circuit power supplies and is a necessary element. Since the average value of the sinusoidal ripple is zero, the average total current is equal to that of the DC component alone.

A photodetector 15 is at an appropriate distance from the LED array 10 to allow it to collect light from a substantial number of LEDs within the LED array to measure the luminous output of the LED array 10. In the context of an LED array traffic signal, the photodetector 15 may be positioned behind the lens facing the LED array 10. The photodetector 15 provides a feedback signal to the power supply 5 so that the power supply 5 can control the current provided to the LED array 10.

As noted above, the luminous output of an LED may vary with both temperature and age, and particularly may degrade with increased temperature and with increased age. To compensate for such degradation, a current supplied to the LED can be increased with increasing temperature and age. Specifically, as a temperature at an LED increases the luminous output of the LED decreases. The photodetector 15 in this instance detects the decrease in luminous output of the LED array 10 and provides a feedback signal to the power supply 5 which controls the power supply 5 to increase the current supplied to the LED array 10. Thereby, the LED array 10 becomes brighter to compensate for any temperature-induced loss of luminosity. Similarly, as LEDs age they become dimmer, and the photodetector 15 can detect any age-induced diminution of the LED array 10. In this situation the photodetector 15 again provides a feedback signal to the power supply 5 to increase the current supplied to the LED array 10, so that the LED array 10 becomes brighter, to thereby compensate for the age-induced diminution of the LED array 10.

In these situations it is important for the photodetector 15 to provide an accurate indication of the luminous output of the LED array 10. This may be particularly problematic in LED array traffic signals since LED traffic signals are designed to have their LED arrays exposed outwardly by a lens, and are designed to be placed outdoors, where there is significant influence from external light sources.

Particularly, sunlight streaming in through a front lens of an LED traffic signal may be focused by the lens and projected onto the LED array 10. A portion of such sunlight may be reflected off the surface of the LED array 10 and onto the photodetector 15. Such reflected sunlight contributes to the output signal of the photodetector 15. The result of this is that the photodetector 15 does not provide an accurate indication of the luminous output of the LED array 10. The present invention has as one object to address such a situation.

To address this situation, the driving circuitry of the present invention includes conditioning circuitry between the photodetector 15 and the power supply 5 to ensure that the light detected by the photodetector 15 is not influenced by external light sources in general, and particularly reflected sunlight from the LED array 10, other than the light output from the LED array 10.

Without this conditioning circuitry, the effect of sunlight reflecting off the LED array 10 is manifested as a DC component in the signal output from the photodetector 15. The present invention includes circuitry to reject this influence from such reflected sunlight by utilizing only the sinusoidal photodetector signal produced by the light originating from the LED array 10. That is, in the present invention, DC and low frequency components caused by stray light sources such as reflected sunlight and detected by the photodetector 15 are rejected.

However, to maintain stable operation of the power supply 5 when the power supply is implemented as a flyback current regulator using a power factor correction IC, it may be necessary for the intensity feedback signal to contain a DC component and a sinusoidal component in phase with the LED current waveform.

To achieve the above-noted operations, the present invention operates as follows.

Figure 3A:
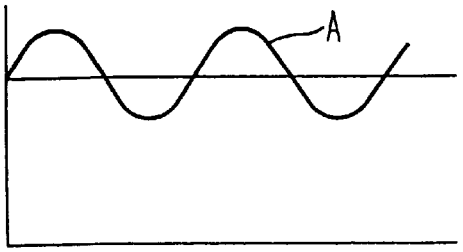
FIGS. 3A–3F show waveforms of signals generated in the LED indicator device and driving circuit of FIGS. 1 and 2.
Figure 3B:
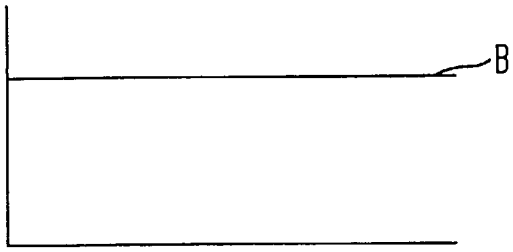

The signal detected by the photodetector 15 is a signal such as is shown as signal A in FIG. 3A. This signal A contains both the sinusoidal and DC components indicative of the LED intensity and a DC component resulting from external light sources such as reflected sunlight. The output of the photodetector 15, i.e. signal A, is then passed through a low pass filter 20, which may have a cutoff frequency in the 10 Hz range, to separate the DC component. The signal output of the low pass filter 20 is signal B shown in FIG. 3B. Signal B thus represents the DC output of photodetector 15 contributed by both LED lighting and by sunlight reflecting off the LED array 10.

Figure 3C:
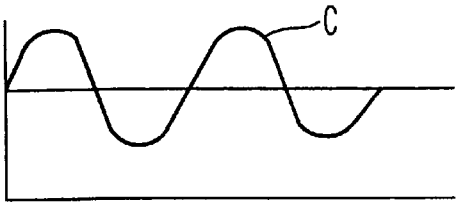
Figure 3C:
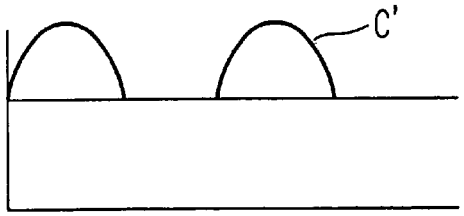
Figure 3D:
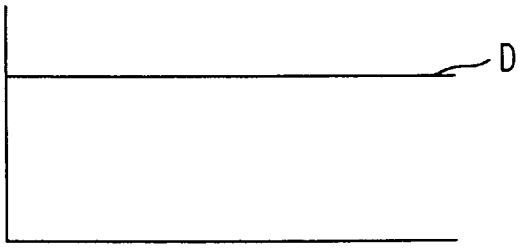
Figure 3E:
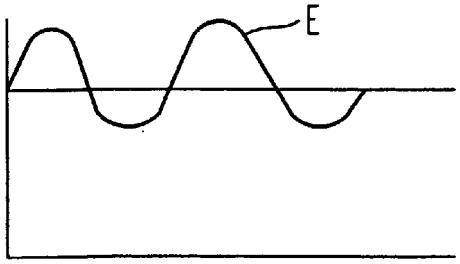
Figure 3F:
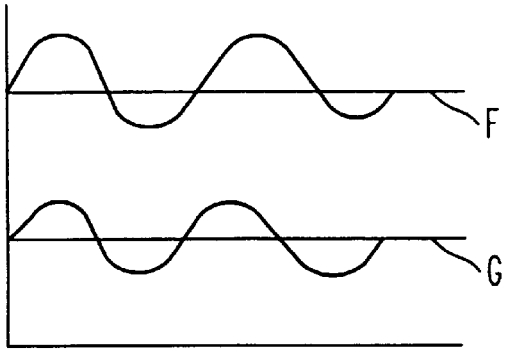

Next, by subtracting the DC component output from the photodetector 15, i.e. signal B, from the original signal output from photodetector 15, i.e. signal A, in difference circuit 25 the sinusoidal AC waveform C is produced. Signal C is then half-wave rectified by rectifier 31 and smoothed and amplified through a smoothing and amplifying circuit 30. This smoothing and amplifying circuit 30 can include a low-pass filter 32 and an amplifier 33. A waveform of the signal C' after being passed through the half-wave rectifier 31 is shown in FIG. 3C'. The signal C' is then low-pass filtered and amplified as necessary to produce the DC signal D output of the smoothing circuit 30 shown in FIG. 3D. The amplitude of this DC signal D is controlled by the amplifier 33 to be proportional to the amplitude of the sinusoidal component of the original waveform signal A.

Next, the present invention synthesizes a feedback signal containing both amplitude and phase information to provide to the power supply 5. This synthesized feedback signal is free of signals attributable from the reflected sunlight and other low frequency light sources.

To achieve this operation, the original signal output of the photodetector 15, i.e. signal A, containing a sinusoidal component indicative of LED intensity and DC components indicative of light from LED array 10 and of stray light is summed in adder 35 with signal D. a DC output indicative of LED intensity. The output of the adder 35 is then the original signal plus a DC signal indicative of LED intensity. This output is then provided to a difference circuit 40. In the difference circuit 40 the signal B output from the low pass filter 20, which has a DC level with an amplitude proportional to the amplitude of the DC component of the photodetector 15, is subtracted from the signal output of adder 35, to thereby create a composite signal E, i.e. E=(A+D)−B. That is, the resulting signal contains only the AC and DC signals indicative of LED intensity. This composite signal E serves as a feedback signal required by the power supply 5 to maintain a desired current in the LED array 10. More particularly, this composite signal E contains amplitude and phase information needed to maintain a stable operation of a current regulator circuit in the power supply 5.

With the above-discussed operation in the present invention, the composite signal E is free of DC components indicative of stray light sensed by the photodetector. Moreover, the composite signal E also contains an appropriate DC component in phase with the sinusoidal signal, as is required by the power supply S when the power supply 5 is implemented as a flyback current regulator. Therefore, in the present invention an accurate intensity feedback signal can be provided to the power supply 5 to control the illumination of the LED array 10.

One problem which may arise in the device of FIG. 1 is that an excessively high current or an excessively low current may be output from the power supply 5 based on the composite feedback signal E. That is, if the LED array 10 is of inadequate intensity, the composite signal E may be a low value, which may result in the power supply 5 providing too much current to the LED array 10. Conversely, if the LED array 10 exceeds intensity limits, the composite signal E may be at too high a value, and too little current may then be supplied from the power supply 5 to the LED array 10. Providing too little current to the LED array 10 may reduce the current drawn by the signal power supply to a level insufficient to properly operate the load switch controlling the LED traffic signal. Reliable operation of the LED array 10 may become unpredictable with respect to light output if too little current is supplied to the LED array 10. When the present invention is implemented as an LED traffic signal, Triac-based load switches are often used to control traffic signals. Such Triac-based load switches may become unreliable when switching low currents, and this can result in traffic signal operational problems.

Figure 2:
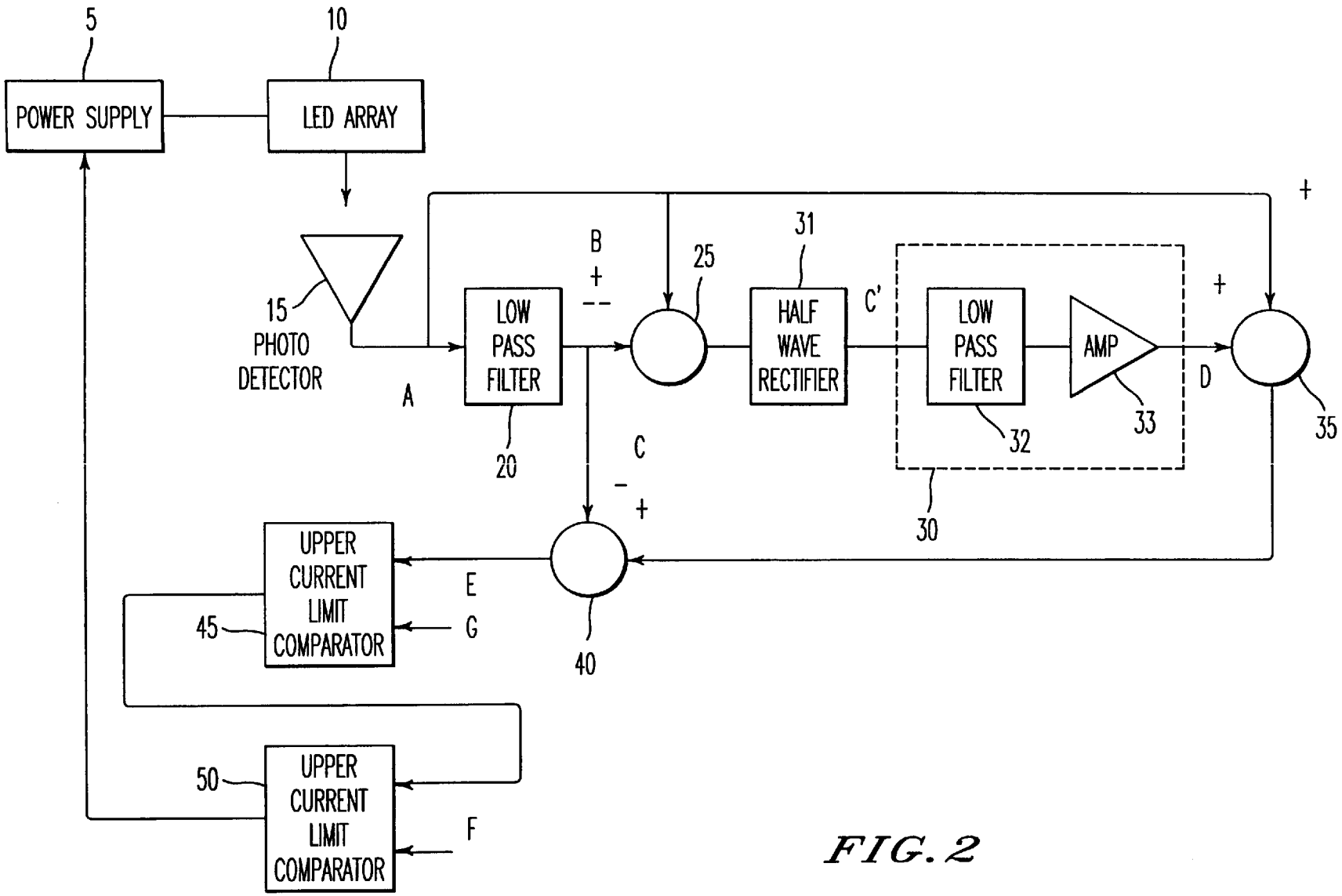
FIG. 2 shows a modification of the LED indicator device and driving circuit of FIG. 1.

To address these concerns, a modification of the embodiment of FIG. 1 is shown in FIG. 2. This embodiment of FIG. 2 is identical to the embodiment of FIG. 1 except the embodiment of FIG. 2 includes an upper current limit comparator 45 and a lower current limit comparator 50. To achieve the upper and lower current limiting operations, in the present invention as shown in FIG. 2 the composite feedback signal E is fed to the upper current limit comparator 45. The upper current limit operation is begun by establishing a current signal G with a level equal to approximately half that of the intensity feedback signal E under normal operating conditions and 25° Celsius. This signal G is compared with the composite intensity feedback signal E such that when the level of signal G exceeds the level of the intensity feedback signal E, the signal G replaces the signal E as a feedback to the power supply 5. This ensures that a signal of a minimum value of signal G is always supplied to the power supply 5, and that accordingly an excessive current is not output from the power supply 5 to the LED array 10.

A simple method of implementing the upper current limit comparator 45 is to apply both signals E and G through a pair of wire-ORed diodes with cathodes connected to ground through a common resistor. In this configuration the larger of the two signals appears across the resistor and the other signal is blocked by its reversed-biased diode. Such a structure essentially forms an analog comparative circuit where only the larger of two analog input signals appears at the output.

The lower current limit operation is achieved by applying the output of the upper limit comparator 45 to the lower current limit comparator 50, and comparing it with a current signal F. Signal F is greater in amplitude than the intensity feedback signal E under normal conditions. In this situation, the higher amplitude LED current signal F is compared to the intensity feedback signal E, and the signal F replaces the intensity signal E to the power supply if the intensity feedback signal is greater than the signal F. This ensures that a signal with the maximum value of signal F is supplied to the power supply 5, and that accordingly a minimum current is always provided from the power supply 5 to the LED array 10.

A simple method of implementing the lower current limit comparator 50 is to apply signals E and F through a pair of wire-ANDed diodes with anodes connected to a positive supply voltage through a common resistor. In this configuration, the smaller of the two signals appears at the anode connections of the two diodes while the other signal is blocked by its reversed-biased diode. This circuit again forms a type of analog comparative circuit. This time, however, only the smaller of the two analog input signals appears at the output.

Figure 4:
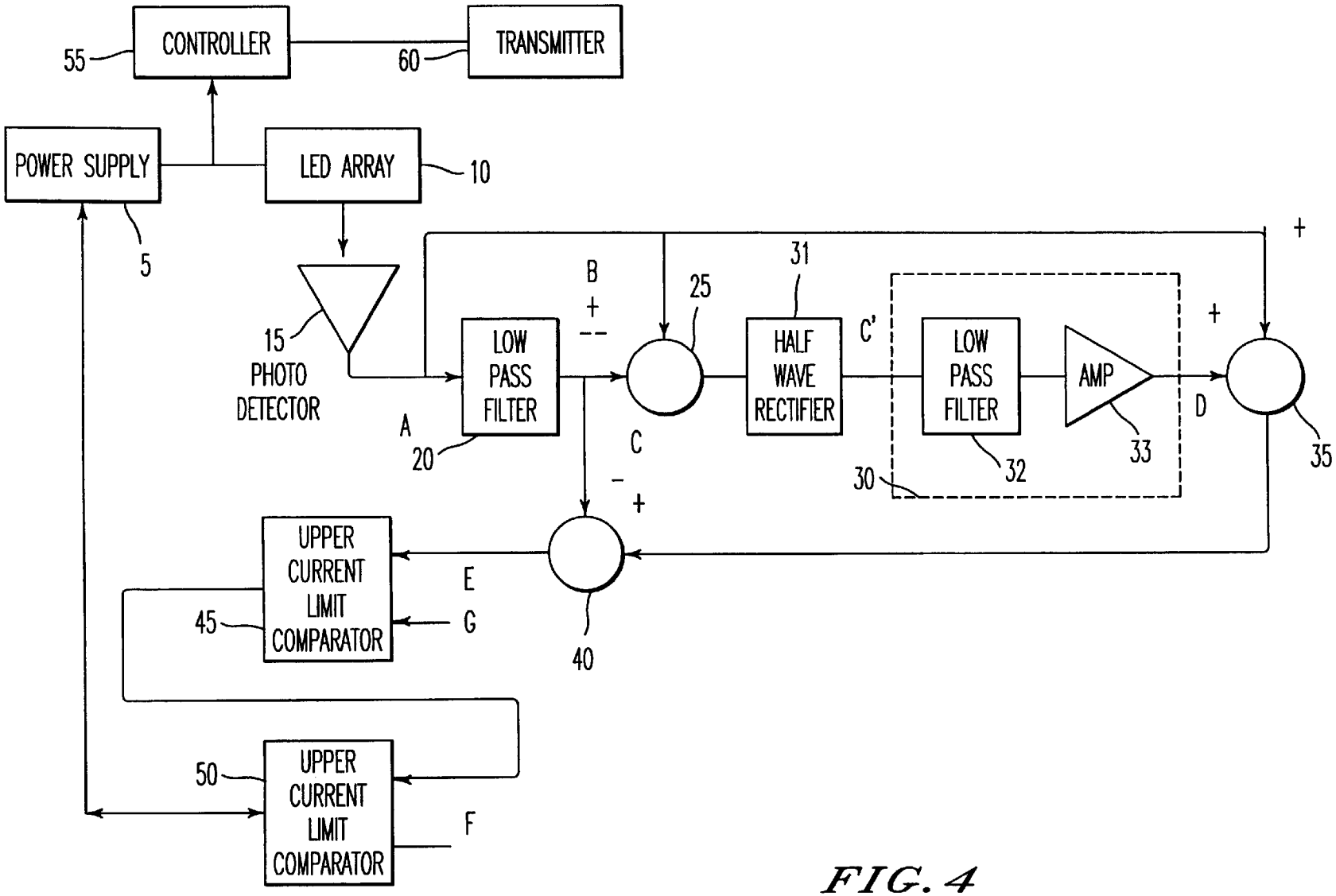
FIG. 4 shows a further modification of the LED indicator device and driving circuit of FIG. 2.

A further feature of the present invention is that the use of the intensity feedback allows the incorporation of additional features which are not otherwise possible in LED indicator devices, such as LED traffic signals. With the intensity feedback operation in the present invention, and a further modification of the present invention as shown in FIG. 4, a controller 55 is provided to monitor the signal from the power supply 5 to the LED array 10 indicating the current output to the LED array 10, and to receive the intensity feedback signal indicating the actual intensity of the LED array 10. By evaluating these signals, a condition of inadequate or excessive intensity of the LED array 10 may be determined when the difference between the signal output from the power supply and the intensity feedback signal exceeds a predetermined threshold. This condition may arise from long-term degradation of the LEDs, or such a condition could be a transitory condition resulting from a temporarily high temperature at the LED array 10. In either case, when such a condition arises a traffic controller circuitry or maintenance personnel can be alerted of such a condition.

In this situation, connected to the controller 55 may be a transmitter 60 which can repeatedly transmit information as to the operation of the driving circuitry of FIGS. 1 and 2. FIG. 4 shows implementation of the controller 55 and transmitter 60 in the circuitry of FIG. 2, however the circuitry of FIG. 1 can also utilize the controller 55 and transmitter 60. The transmitter 60 may be a simple infrared transmitter which sends one code to indicate a normal operation of the LED device, and which transmits a second code, or alternatively no code, to indicate that the LED device is functioning improperly, i.e., that the difference between the signal output from the power supply 5 to the LED array 10 and the intensity feedback signal exceeds a predetermined threshold. This second code could also be sent when the upper current limit comparator 45 is engaged.

It is also clearly possible to have additional codes indicating various degrees of non-compliance with any intensity requirements.

Maintenance personnel could then be provided with receivers, for example hand-held infrared receivers, which they could point at a traffic signal including the transmitter 60 to read the codes being transmitted. The received codes could then be decoded to provide an indication of the operation of the LED traffic signal.

Still another approach to transmitting such information could employ power line communication in the transmitter 60. In this situation, a microprocessor in a central controller (not shown) could periodically poll a series of traffic signals by sending appropriate codes over the power lines. When a traffic signal circuit receives its identification code from controller 55, it can respond by transmitting via the same power line, through transmitter 60, its current status with a system using the first and second codes as noted above. In one embodiment, the central controller may record in its memory instances when specific traffic signals are not meeting requirements. Alternatively, the transmitter 60 may be equipped with a modem or radio link allowing the intensity information to be downloaded immediately to a main traffic control center.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An LED indicator system, comprising:

(a) at least one LED;

(b) a power supply to supply current to the at least one LED based on a received synthesized intensity feedback signal;

(c) a photodetector to detect a luminous output of the at least one LED, and to correspondingly output a detection signal;

(d) a compensation circuit to remove components of stray light from at least one source other than said at least one LED from the detection signal to generate the synthesized intensity feedback signal provided to the power supply.

2. The LED indicator system according to claim 1, wherein said detection signal includes a sinusoidal component and a DC component from the at least one source, and wherein said conditioning circuit comprises:

i) a low pass filter to extract a first substantially DC signal proportional to a DC component in the detection signal; and ii) a difference circuit to subtract the first substantially DC signal from the detection signal to generate a sinusoidal AC waveform.

3. The LED indicator system according to claim 2, wherein said conditioning circuit further comprises:

iii) a smoothing and amplifying circuit to smooth and amplify the sinusoidal AC waveform to generate a second substantially DC signal proportional to a level of the sinusoidal AC component in the detection signal.

4. The LED indicator system according to claim 3, wherein said conditioning circuit further comprises:

iv) an adder circuit to add the second substantially DC signal and the detection signal, to generate an intermediate composite signal; and v) a second difference circuit to subtract the first substantially DC signal from the intermediate composite signal and to generate the synthesized intensity feedback signal.

5. The LED indicator system according to claim 4, wherein said conditioning circuit further comprises:

vi) an upper current limit comparator to ensure that the synthesized intensity feedback signal has a minimum value; and vii) a lower current limit comparator to ensure that the synthesized intensity feedback signal does not exceed a maximum value.

6. The LED indicator system according to claim 1, further comprising:

(e) a controller to compare the current supplied by the power supply to the at least one LED with the synthesized intensity feedback signal.

7. The LED indicator system according to claim 6, further comprising:

(f) a transmitter to transmit a signal indicating a result of the comparison executed by the controller.

8. The LED indicator system according to claim 5, further comprising:

(e) a controller to compare the current supplied by the power supply to the at least one LED with the synthesized intensity feedback signal.

9. The LED indicator system according to claim 8, further comprising:

(f) a transmitter to transmit a signal indicating a result of the comparison executed by the controller.

10. A driving circuit for at least one LED, comprising:

(a) a power supply to supply current to the at least one LED based on a received synthesized intensity feedback signal;

(b) a photodetector to detect a luminous output of the at least one LED, and to correspondingly output a detection signal;

(c) a compensation circuit to remove components of stray light from at least one source other than said at least one LED from the detection signal to generate the synthesized intensity feedback signal provided to the power supply.

11. The driving circuit according to claim 10, wherein said detection signal has a sinusoidal AC component and a DC component from the at least one source, and wherein said conditioning circuit comprises:

i) a low pass filter to filter the detection signal to generate a first substantially DC signal proportional to a DC component in the detection signal; and ii) a difference circuit to subtract the first substantially DC signal from the detection signal to generate a sinusoidal AC waveform.

12. The driving circuit according to claim 11, wherein said conditioning circuit further comprises:

iii) a smoothing and amplifying circuit to smooth and amplify the sinusoidal AC waveform to generate a second substantially DC signal proportional to a level of the sinusoidal AC component in the detection signal.

13. The driving circuit according to claim 12, wherein said conditioning circuit further comprises:

iv) an adder circuit to add the second substantially DC signal to the detection signal, to generate an intermediate composite signal; and v) a second difference circuit to subtract the first substantially DC signal from the intermediate composite signal to generate the synthesized intensity feedback signal.

14. The driving circuit according to claim 13, wherein said conditioning circuit further comprises:

vi) an upper current limit comparator to ensure that the synthesized intensity feedback signal has a minimum value; and vii) a lower current limit comparator to ensure that the synthesized intensity feedback signal does not exceed a maximum value.

15. The driving circuit according to claim 10, further comprising:

(d) a controller to compare the current supplied by the power supply to the at least one LED with the synthesized intensity feedback signal.

16. The driving circuit according to claim 15, further comprising:

(e) a transmitter to transmit a signal indicating a result of the comparison executed by the controller.

17. The driving circuit according to claim 14, further comprising:

(e) a controller to compare the current supplied by the power supply to the at least one LED with the synthesized intensity feedback signal.

18. The driving circuit according to claim 17, further comprising:

(f) a transmitter to transmit a signal indicating a result of the comparison executed by the controller.

19. An LED indicator system, comprising:

(a) at least one LED;

(b) a power supply to supply current to the at least one LED based on a received synthesized intensity feedback signal;

(c) a photodetector to detect a luminous output of the at least one LED, and to correspondingly output a detection signal;

(d) means for removing components of stray light from at least one source other than said at least one LED from the detection signal to generate the synthesized intensity feedback signal provided to the power supply.

* * * * *